US005733152A

United States Patent [19]

Freitag

[11] Patent Number: 5,733,152

[45] Date of Patent: Mar. 31, 1998

[54] BATTERY TERMINAL ADAPTOR AND CONNECTOR

[75] Inventor: Henrik Freitag, Wood Dale, Ill.

[73] Assignee: Royal Die & Stamping Co., Inc., Bensenville, Ill.

[21] Appl. No.: 728,030

[22] Filed: Oct. 9, 1996

[51] Int. Cl.[6] ..... H01R 4/42

[52] U.S. Cl. ..... 439/763; 439/762

[58] Field of Search ..... 439/763, 764, 439/761, 762, 759

[56] References Cited

U.S. PATENT DOCUMENTS

| | | | |
|---|---|---|---|
| Re. 26,486 | 11/1968 | Haegert | 439/763 |
| 1,661,375 | 3/1928 | Leighton | 439/762 |
| 3,568,138 | 3/1971 | Bakker | 439/762 |
| 3,922,058 | 11/1975 | Kinnear | 439/811 |
| 5,087,214 | 2/1992 | Dewar | 439/762 |
| 5,169,338 | 12/1992 | Dewar et al. | 439/522 |
| 5,183,419 | 2/1993 | Dewar | 439/762 |
| 5,221,219 | 6/1993 | Thomson | 439/762 |
| 5,252,091 | 10/1993 | Fujita et al. | 439/499 |
| 5,290,646 | 3/1994 | Asao et al. | 429/178 |
| 5,302,142 | 4/1994 | Tabata | 439/762 |
| 5,302,143 | 4/1994 | Inoue et al. | 439/762 |
| 5,346,407 | 9/1994 | Hood | 439/522 |
| 5,389,466 | 2/1995 | Inoue et al. | 429/178 |
| 5,431,580 | 7/1995 | Tabata | 439/289 |
| 5,445,907 | 8/1995 | Ito et al. | 429/178 |
| 5,454,741 | 10/1995 | Okada | 439/762 |
| 5,466,164 | 11/1995 | Miyazaki et al. | 439/164 |
| 5,486,119 | 1/1996 | Nabeshima et al. | 439/489 |
| 5,486,123 | 1/1996 | Miyazaki | 439/825 |
| 5,486,434 | 1/1996 | Aoyama | 429/178 |
| 5,492,780 | 2/1996 | Okada | 439/121 |
| 5,498,178 | 3/1996 | Tabata | 439/762 |

*Primary Examiner*—Neil Abrams
*Assistant Examiner*—T. C. Patel
*Attorney, Agent, or Firm*—Wallenstein & Wagner, Ltd.

[57] ABSTRACT

A battery terminal connector and adaptor providing improved mechanical and electrical connection to a battery terminal post, is disclosed. The connector includes a contacting portion having a base and perpendicular sides for securing to the terminal post of a battery, and a ferrule portion having a variety of configurations for connecting to a battery cable.

13 Claims, 5 Drawing Sheets

BATTERY TERMINAL ADAPTOR AND CONNECTOR

DESCRIPTION

1. Technical Field

This invention relates to a battery terminal connector and adaptor, and more particularly to a body portion formed from a single sheet of metal, the body portion including a contacting portion and a ferrule portion.

2. Background Prior Art

Storage batteries of the type used in automobiles, trucks and the like, generally have a terminal post made of a lead alloy material with a cylindrical or frustoconical shape. The battery is interconnected to the vehicle electrical system by a battery cable assembly having connectors which clamp to the battery posts providing an electrical and mechanical connection.

A conventional connector for connecting cables to the battery is a molded, generally U-shaped device with a bolt passing through outwardly projecting yoke-like arms for securely clamping the connector to the battery post. The connector may also be a stamped metal battery terminal connector, fabricated from sheet metal.

The present invention provides an improved battery terminal connector having improved mechanical and electrical connection to a battery terminal post and enhanced resistance to rotation while connected to the terminal post. The invention is also cost efficient to manufacture and adaptable for automated assembly and production. An additional advantage of the invention is its adaptability to different automobile models and batteries in that the ferrule portion can be a variety of configurations and styles. The variable configurations of the ferrule portion may also eliminate cable length so that the battery cables do not extend above the top of the battery, and also allows the battery cable to fit into tighter spaces, and thus more efficiently around the battery.

SUMMARY OF THE INVENTION

In accordance with the invention, the battery terminal connector comprises a body portion folded from a single sheet of metal, the body portion including a contacting portion and a ferrule portion. The contacting portion includes a first side opposed from and interconnected to a second side. Each side includes slotted openings in offset alignment to one another, which open frontward toward the ferrule portion. Each of the sides further includes an extending tab portion, adapted to overlap and thereby attach the contacting portion to the terminal post of a battery. The ferrule portion is integral with and positioned perpendicular to one of the sides and adapted for connecting the body to a battery cable.

DETAILED DESCRIPTION

Figure 1:
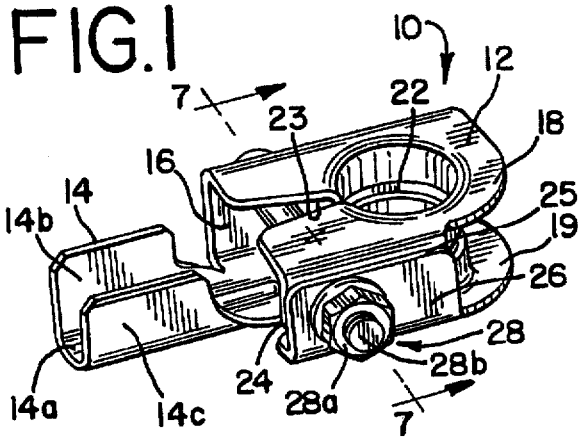
FIG. 1 is a perspective view of the battery terminal connector and adaptor of the present invention.

While this invention is susceptible of embodiments in many different forms, there is shown in the drawings and will herein be described in detail, preferred embodiments of the invention with the understanding that the present disclosure is to be considered as an exemplification of the principles of the invention and is not intended to limit the broad aspects of the invention to the embodiments illustrated.

A battery terminal connector and adaptor, generally designated 10, is shown in FIG. 1. The connector 10 comprises essentially two main portions stamped from a single piece of metal, a contacting portion 12 and a ferrule portion 14. The contacting portion 12 is to be fitted over a typically frustoconical shaped terminal post (not shown) of a battery for a motor vehicle. The ferrule portion 14 is adapted for connecting and securing a battery cable (not shown) through the connector portion 12 to the battery.

As shown in FIG. 1, the contacting portion 12 is formed by a first semicircular side 18 opposed from and interconnected by a flat connecting section 16 to a second semicircular side 19. Opposed from the connecting section 16, each side includes a set of end tabs 25, 26, to be described in further detail below.

Figure 2:
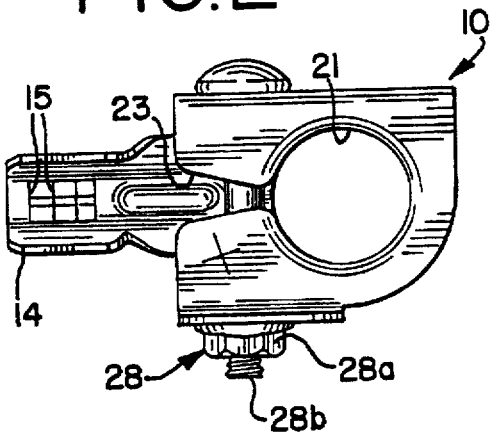
FIG. 2 is a top view of the connector of FIG. 1.
Figure 3:
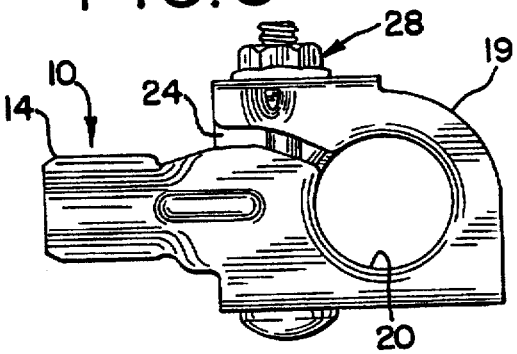
FIG. 3 is a bottom view of the connector of FIG. 1.
Figure 6:
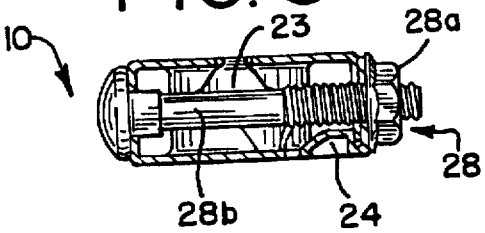
FIG. 6 is a sectional view seen on line 7—7 of FIG. 1.
Figure 8:
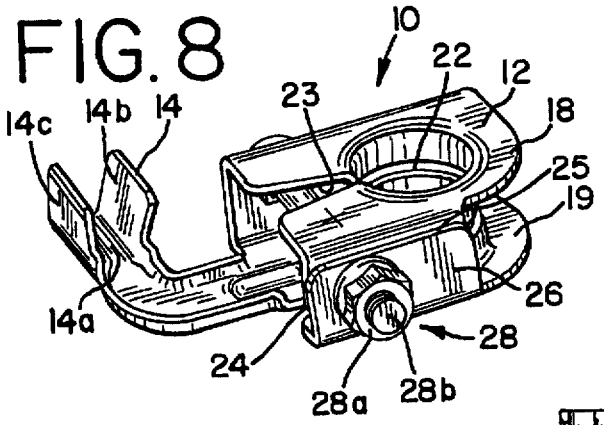
FIG. 8 is a perspective view of a second embodiment of the battery terminal connector and adaptor of the present invention.
Figure 9:
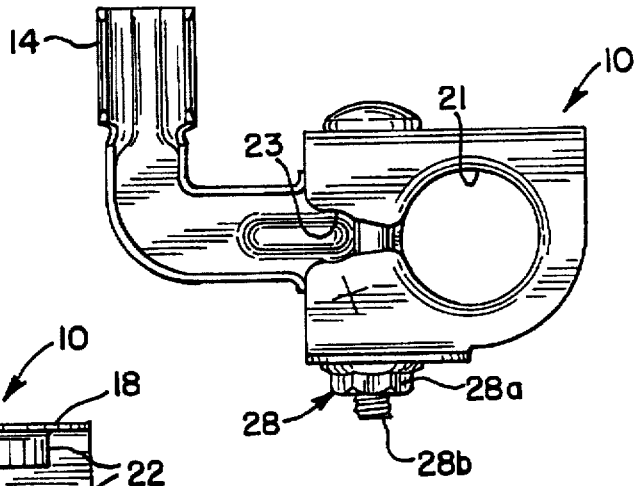
FIG. 9 is a top view of the connector of FIG. 8.
Figure 10:
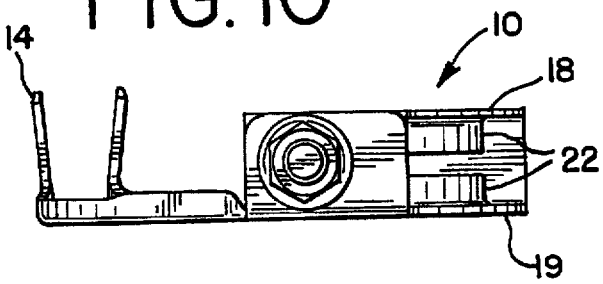
FIG. 10 is a side view of the connector of FIG. 8.
Figure 11:
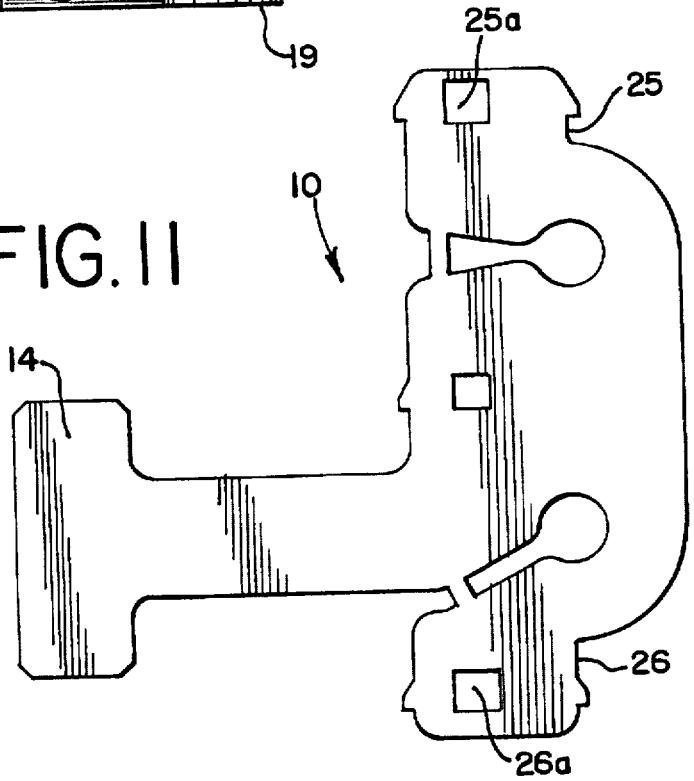
FIG. 11 shows a blank strip for forming the connector of FIG. 8.

The sides 18, 19 each include at least one slotted opening 23, 24, which open toward the front, or ferrule portion 14 of the connector. FIG. 2 shows one of the slotted openings 23, while FIG. 3 shows the opposite slotted opening 24. The slotted openings 23, 24 are situated across from one another in a slightly off-set alignment, as shown in the sectional view of FIG. 6. Off-set alignment of the slotted openings 23, 24 offers several advantages, including improved contact with the battery terminal post providing better current, and alignment of the ferrule portion 14 to the center line of the connector portion 12 to accommodate a variety of battery models, as will be described.

Figure 4:
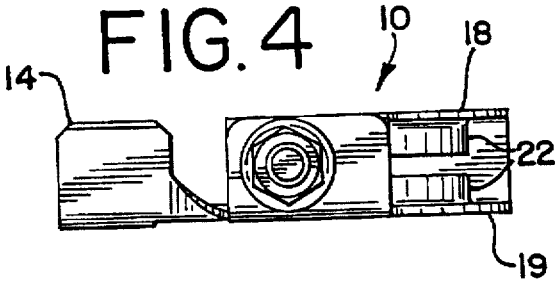
FIG. 4 is a right side view of the connector of FIG. 1.
Figure 5:
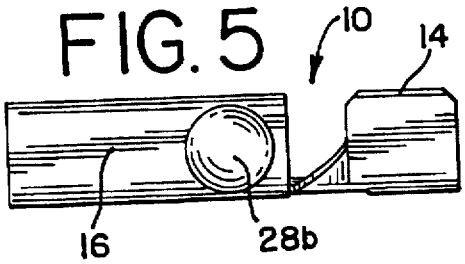
FIG. 5 is a left side view of the connector of FIG. 1.

Each side 18, 19 has a centrally positioned aperture 20, 21, with each aperture adapted for receiving the terminal post of a battery. As best shown in FIG. 4, each aperture is stamped out with flanges 22 projecting inwardly toward the center of the contacting portion 12. The apertures 20, 21 and corresponding flanges 22 are designed to position the connector 10, and specifically the contacting portion 12, securely around the frustoconical shape of the battery terminal post. Specifically, because the inner diameter of the first aperture 20 is slightly smaller than the inner diameter of the second aperture 21, to accommodate the frustoconical shape of the terminal post, the flanges 22 closely engage the terminal post enhancing the electrical connection and mechanical retention of the connector 10 to the terminal post. Further, the apertures 20, 21 are dimensioned for a snug fit on the terminal post when the connector 10 is placed on the terminal post in the open position prior to clamping.

The distal ends of the first and second sides 18, 19 include generally rectangular, end tab portions 25, 26. The end tabs 25, 26 are adapted for overlapping engagement and attachment to one another (FIG. 1). Each of the end tabs 25, 26 includes a central opening 25*a*, 26*a* for receiving a fastener 28. Any conventional fastener 28 can be used, with a threaded fastener such as a nut and bolt assembly, shown in FIG. 6, being preferred for a secure connection. When the end tabs 25, 26 are aligned in overlapping configuration to one another, the fastener 28 can be threaded through the openings 25*a*, 26*a*.

When the connector 10 is applied to the battery terminal post, the nut 28*a* and bolt 28*b* assembly may already be positioned through the openings 25*a*, 26*a* of the end tabs 25, 26. If the fastener assembly 28 is in place on the connector 10, the nut 28*a* is loosened somewhat, allowing the inner diameters of the apertures 20, 21 to expand so the connector can be slid easily over the terminal post. As previously noted, the dimensions of the apertures 20, 21, and particularly the differences in the inner diameter dimensions of the apertures, provide initial snug seating of the connector 10 to the terminal post.

When the connector 10 is properly seated about the terminal post, the bolt 28*b*, if not in place, is fed through the aligned central openings 25*a*, 26*a*. The nut 28*a* is then tightened through clockwise rotation, drawing the end tabs 25, 26 and hence the sides 18, 19 and flanges 22 together into closer contact with the battery terminal post. As the sides 18, 19 are drawn together, the flanges 22 will clamp securely around the terminal post, producing good electrical and mechanical contact with the terminal post. Conversely, rotating the nut 28*a* in the opposite direction causes the end tabs to draw apart, opening up the sides 18, 19 for easy removal of the connector 10 from the terminal post. Thus, the nut and bolt fastener assembly 28 provides a convenient means for attachment and disconnection of the connector 10 from the terminal post.

In addition, the nut and bolt assembly 28, and its tight, force fit mounting within the opening 25*a*, 26*a* of the end tabs 25, 26 contributes to advantageous current carrying and heat generating characteristics of the connector 10. Further, the added metal mass of the nut 28*a* and the good electrical continuity between the nut and the end tabs minimizes resistance so less heat is generated and improves heat dissipation, resulting in lower running operating temperature. Accordingly, the nut 28*a* contributes to the current carrying capability of the connector 10 and also functions as a heat sink.

Integral with and positioned perpendicular to either one of the sides 18, 19 is the ferrule portion 14 of the connector (FIG. 1). The ferrule portion 14 is generally U-shaped, having a flat base surface 14*a*, surrounded by opposed perpendicular sides 14*b*, 14*c* for receiving a cable for engagement with the battery terminal. When the cable is inserted within the ferrule portion 14 onto the flat base surface 14*a*, the sides 14*b*, 14*c* are crimped together and around the cable, securing the cable in position.

Preferably, the inner surface of the base 14*a* and sides 14*b*, 14*c* of the ferrule portion 14 are adapted to grippingly engage the battery cable. As shown in FIG. 2, a plurality of parallel gripping serrations 15 contribute to the gripping engagement of a cable within the ferrule portion 14. The serrations 15 extend perpendicular to the longitudinal axis of the ferrule portion 14, running along the base surface 14*a*, and approximately half way up the sides 14*b*, 14*c*. The serrations 15 secure the cable within the ferrule portion 14 and prevent slippage, enhancing the mechanical and electrical connection of the cable to the battery.

An advantage of the present invention over the prior art is found in the adaptability of the ferrule portion 14. Preferably, the ferrule portion 14 is located perpendicular to one of the sides 20. This positioning allows for a variety of ferrule configurations and makes the connector easier to manufacture, as described below.

Figure 15:
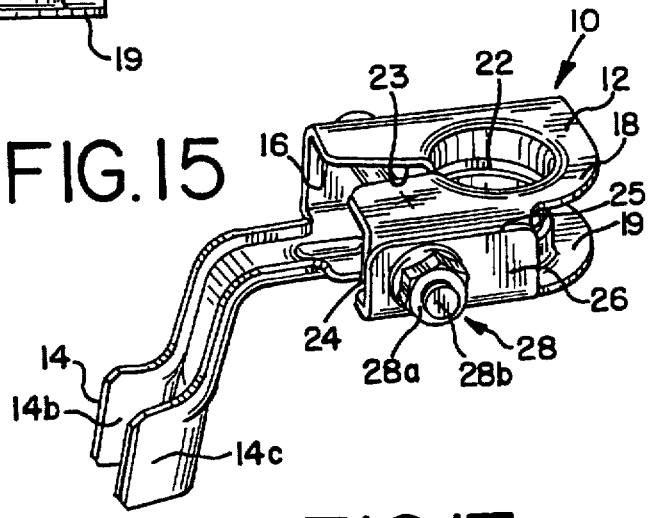
FIG. 15 is a perspective view of a fourth embodiment of the battery terminal connector and adaptor of the present invention.
Figure 16:
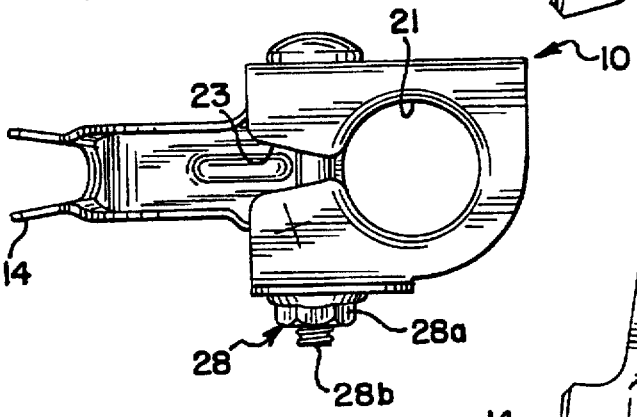
FIG. 16 is a top view of the connector of FIG. 15.
Figure 17:
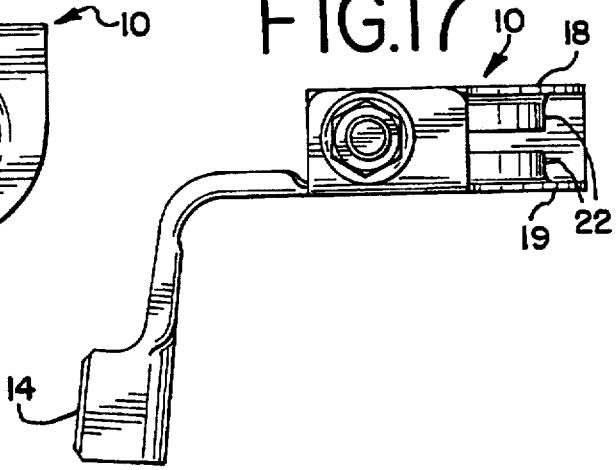
FIG. 17 is a side view of the connector of FIG. 15.
Figure 18:
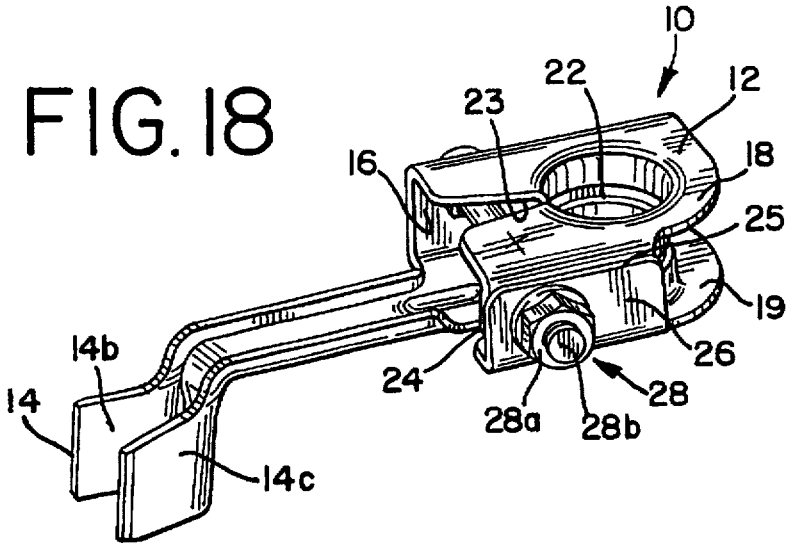
FIG. 18 is a perspective view of a fifth embodiment of the battery terminal connector and adaptor of the present invention.
Figure 19:
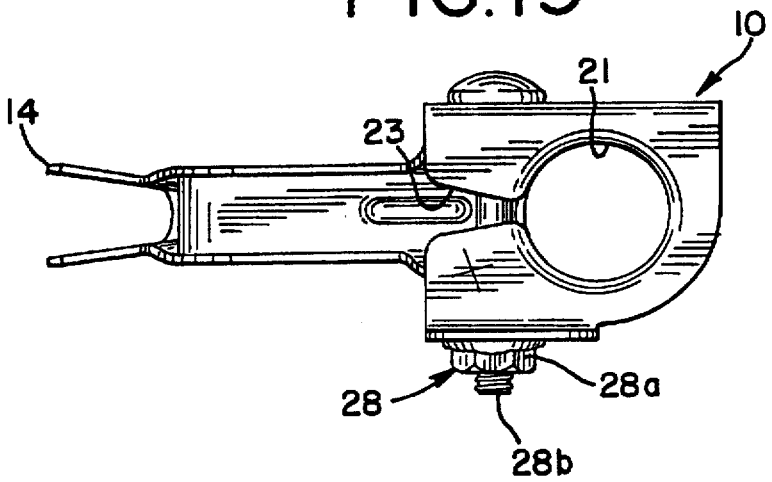
FIG. 19 is a top view of the connector of FIG. 18.
Figure 20:
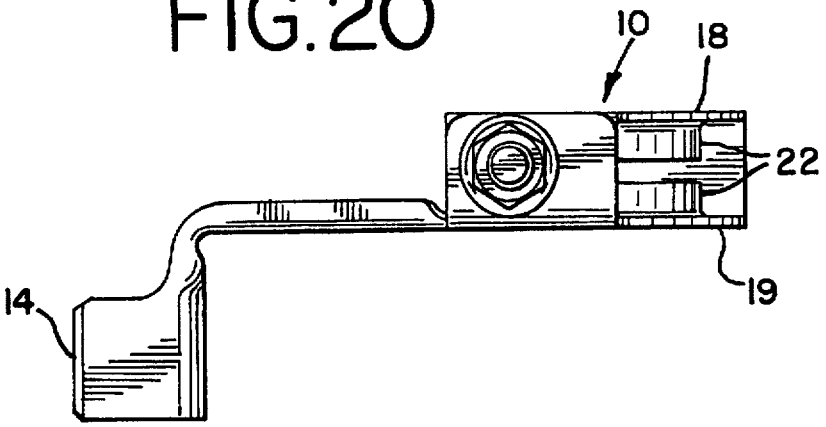
FIG. 20 is a side view of the connector of FIG. 18.
Figure 21:
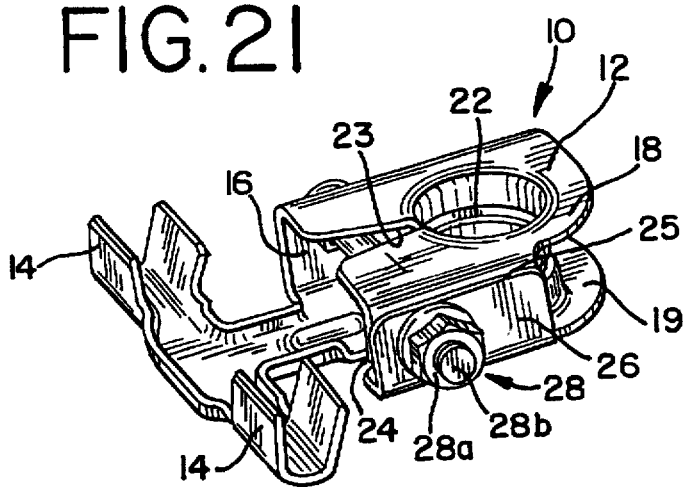
FIG. 21 is a perspective view of a sixth embodiment of the battery terminal connector and adaptor of the present invention.
Figure 22:
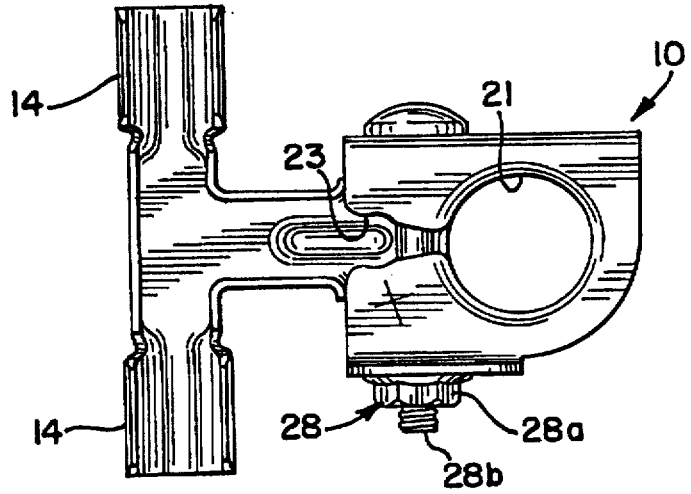
FIG. 22 is a top view of the connector of FIG. 21.
Figure 23:
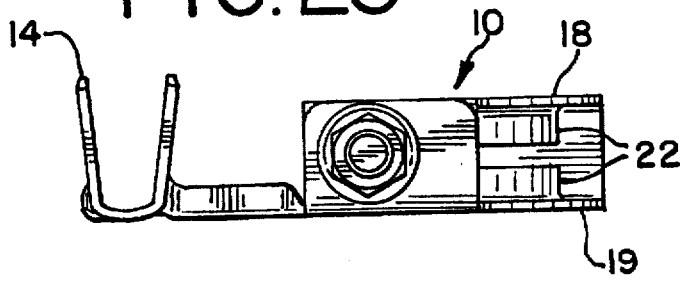
FIG. 23 is a side view of the connector of FIG. 21.

Possible ferrule configurations useful in the present invention are shown in the FIGS. 8–23. Specifically, FIGS. 8–11 illustrate a second embodiment of the present invention, FIGS. 12–illustrate a third embodiment, FIGS. 15–17 illustrate a fourth embodiment, FIGS. 18–20 illustrate a fifth embodiment, and FIGS. 21–23 illustrate a sixth embodiment. The multiple ferrule portion configurations and styles provide the connector with the adaptability to be used on a variety of automobile models and batteries. Further, the configuration of the ferrule portion 14 eliminates the length of cable required so that the cable does not extend to the top of the battery, and allows the battery cable to fit into tighter spaces around the battery for a more compact arrangement. Finally, the embodiment illustrated in FIGS. 21–23, allows for connecting two cables simultaneously to a single connector. Adaptability and versatility of the ferrule portion 14 of the present invention provides added advantages over prior art connectors.

Figure 7:
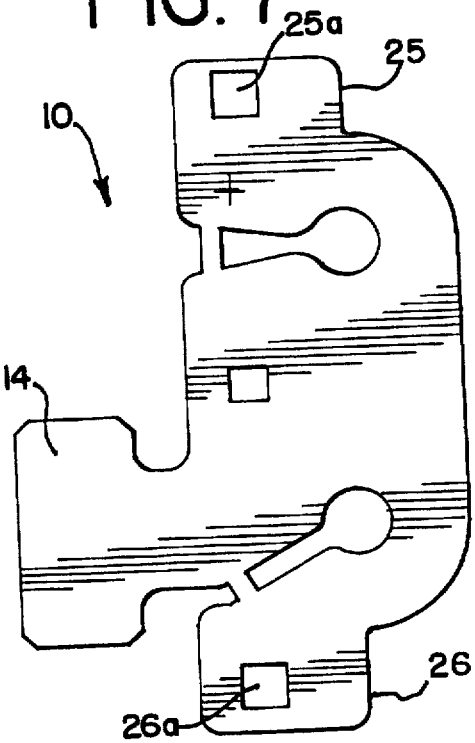
FIG. 7 shows a blank strip for forming the connector of FIG. 1.

The connector 10, with the exception of the fastener assembly 28, formed from a metal blank. As shown in FIG. 7, and a second embodiment in FIG. 11, the blank for the body portion of the connector 10 is stamped from a single piece of sheet metal. The blank comprises an elongated central web with opposite ends forming the end tabs 25, 26 spaced equi-distance from the central transverse axis of the web. Preferably, the blank is stamped perpendicular to the axis of the metal web rather than along the direction of the web. Stamping the blanks in this manner allows for different configurations for the ferrule portion 14 (FIGS. 7 and 11), which is positioned along the perpendicular axis of the web. Manufacturing the connector 20 as a single blank is convenient and cost-efficient.

A stamped, one-piece metal connector has been described which achieves good mechanical and electrical connection to the terminal post of a battery. The unique embodiments of the connector of the present invention offer enhanced adaptability to a variety of battery and vehicular models, and affords easy and convenient connection and disconnection from the battery post through rotation of a standard fastener.

It will be understood that the invention may be embodied in other specific forms without departing from the spirit or central characteristics thereof. The present embodiments, therefore, are to be considered in all respects as illustrative and not restrictive, and the invention is not to be limited to the details given herein.

I claim:

1. A battery terminal connector comprising:

a body portion folded from a single sheet of metal, the body portion including a contacting portion for engaging a battery terminal post and a ferrule portion for attachment to a battery cable, the ferrule portion coplanar with and extending from one of the sides and adapted for connecting the contacting portion to the battery cable, the contacting portion including a first side and an opposed second side and having apertures for engagement with the battery terminal;

a set of slotted openings formed within and coplanar with the first and second sides communicating with the apertures, the slotted openings asymmetrically aligned across from each other; and, end tab portions extending from a distal edge of each of the first and second sides and adapted for overlapping and receiving a fastening means for clamping the contacting portion to the terminal post of a battery.

2. The battery terminal connector of claim 1 wherein the fastener means for clamping the contacting portion to the terminal post includes a threaded fastener that when rotated in a first direction draws the first and second sides toward one another and snugly around the terminal post, and when rotated in a second direction draws apart the first and second sides from each other and from the terminal post.

3. The battery terminal connector of claim 1 wherein the first and second sides each includes a centrally positioned aperture adapted for engagement with the terminal post of the battery.

4. The battery terminal connector of claim 3 wherein the aperture within the first side has a different inner diameter from the aperture within the second side and wherein each aperture further includes inwardly projecting flanges for seating the contacting portion around the terminal post.

5. The battery terminal connector of claim 1 wherein the ferrule portion is integral with and positioned perpendicular to one of the sides and adapted for connecting the body to a battery cable.

6. The battery terminal connector of claim 5 wherein the ferrule portion is adapted for gripping engagement with a battery cable wherein the ferrule portion is adapted for receiving at least two separate battery cables.

7. The battery terminal of claim 6 wherein the ferrule portion is further adaptable for a variety of battery cables.

8. The battery terminal of claim 7 wherein the ferrule portion is adapted for receiving at least two separate battery cables.

9. A battery terminal connector comprising:

a body portion formed from a single sheet of metal, comprising a contacting portion for attachment to a terminal post of a battery and a ferrule portion adapted for receiving a battery cable;

the contacting portion including a base and a first and a second side disposed to a connecting portion, the sides adapted to receive the terminal post of the battery;

the sides further including extending end tab portions the end tabs adapted for securing the sides into contact engagement with the terminal post of a battery;

a set of slotted openings formed within and coplanar with the first and second sides communicating with the contacting portion, the slotted openings assymmetrically aligned across from each other: and, the ferrule portion coplanar with and extending from one of the sides and adapted for connecting the contacting portion to the battery cable.

10. The battery terminal connector of claim 9 wherein the end tabs are further adapted for overlapping relationship to one another and for receiving a fastener means for securing the sides into contact engagement with the terminal post of the battery.

11. The battery terminal connector of claim 9 wherein the ferrule portion is adapted for gripping engagement with a battery cable.

12. The battery terminal connector of claim 9 wherein each of the first and second sides include apertures for engagement with the terminal post of the battery.

13. The battery terminal connector of claim 12 wherein the apertures of the first and second sides include inwardly projecting flange portions for enhanced contact with the terminal post of the battery.

* * * * *

UNITED STATES PATENT AND TRADEMARK OFFICE

CERTIFICATE OF CORRECTION

PATENT NO. : 5,733,152

DATED : March 31, 1998

INVENTOR(S) : Henrik Freitag

It is certified that error appears in the above-identified patent and that said Letters Patent is hereby corrected as shown below:

In Column 5, line 11, "battery cable," should read "battery cable;"

In Column 6, line 22 "each other: and," should read "each other; and,"

Figure 12:
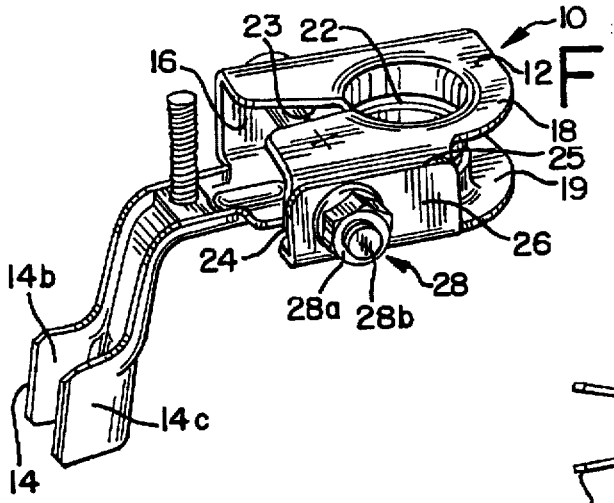
FIG. 12 is a perspective view of a third embodiment of the battery terminal connector and adaptor of the present invention.
Figure 13:
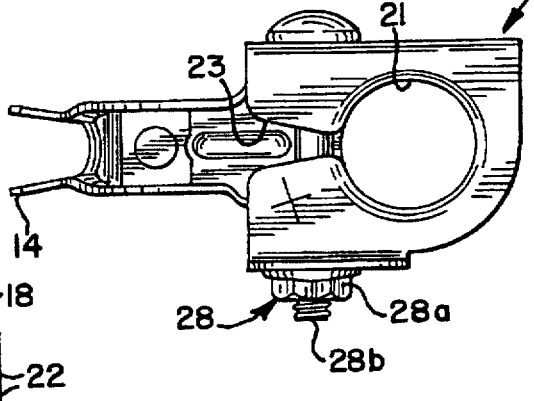
FIG. 13 is a top view of the connector of FIG. 12.
Figure 14:
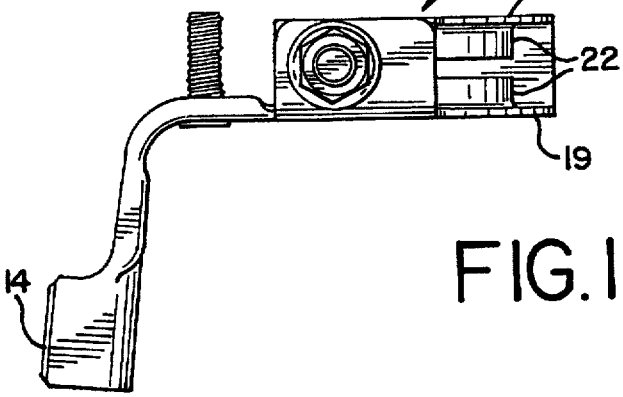
FIG. 14 is a side view of the connector of FIG. 12.

In Column 4, line 27, "FIGS. 12-illustrate" should read "FIGS. 12-14 illustrate"

Signed and Sealed this

Fifteenth Day of December, 1998

Bruce Lehman

*Attest:*

BRUCE LEHMAN

*Attesting Officer*

*Commissioner of Patents and Trademarks*